United States Patent [19]

Juncu

[11] Patent Number: 4,994,776

[45] Date of Patent: Feb. 19, 1991

[54] MAGNETIC LATCHING SOLENOID

[75] Inventor: Gheorghe C. Juncu, Fullerton, Calif.

[73] Assignee: Babcock, Inc., Orange, Calif.

[21] Appl. No.: 378,764

[22] Filed: Jul. 12, 1989

[51] Int. Cl.[5] ..... H01F 7/06

[52] U.S. Cl. ..... 335/234; 335/230; 335/81; 335/85

[58] Field of Search ..... 335/79, 81, 85, 229, 335/230, 234, 253, 254

[56] References Cited

U.S. PATENT DOCUMENTS

| | | | |
|---|---|---|---|
| 4,316,167 | 2/1982 | Koehler | 335/234 |
| 4,635,016 | 1/1987 | Guery et al. | 335/234 X |
| 4,644,311 | 2/1987 | Guery et al. | 335/230 |

FOREIGN PATENT DOCUMENTS

| | | | |
|---|---|---|---|
| 75806 | 5/1983 | Japan | 335/230 |
| 58-93302 | 6/1983 | Japan | 335/230 |
| 148305 | 8/1984 | Japan | 335/230 |

*Primary Examiner*—Leo P. Picard
*Assistant Examiner*—Trinidad Korka
*Attorney, Agent, or Firm*—G. Donald Weber, Jr.

[57] ABSTRACT

A latching solenoid which effects latching through a magnetic flux arrangement rather than a electromechanical latching mechanism. An electro-magnetic arrangement is used to move the solenoid from one latched position to the other.

18 Claims, 1 Drawing Sheet

MAGNETIC LATCHING SOLENOID

BACKGROUND

1. Field of the Invention

This invention relates to solenoids, in general, and to latching solenoids in particular and, especially, latching solenoids which are magnetically latched.

2. Prior Art

There are many electro-magnetic devices known in the prior art. Many of these electro-magnetic devices take the form of coils of wire mounted on cores, usually of ferromagnetic material. In many cases the devices take the form of relays which move armatures relative to the core in response to an electrical signal applied to the coil.

These types of devices are often referred to as switches or relays.

In related devices, the core, per se, moves with respect to the coil and effects an action as a result of the movement of the core. These devices are normally referred to as solenoids.

In most solenoids, an electrical signal is applied to a coil which generates electro-magnetic flux in a core. The flux operates to move the core relative to the coil and to effect a work function or operation. However, in many cases the moveable core remains in the position only in response to the application of the electrical signal to the coil. The solenoid mechanism does not latch in any particular position.

In order to provide a latching arrangement in most solenoids known in the art, it is requried to provide a separate electro-mechnical latching mechanism. However, the devices known in the prior art are subject to various problems and tend to lack reliability.

Typically, a solenoid is defined as an electrically energized coil which may consist of one or more layers of winding. It is the basis of most forms of electro-magnets and is, thus, part of the operating mechanism of many operating devices. One of the simplest forms and, at the same time, widely used form of solenoid is the so-called plunger-type solenoid. In this apparatus a coil is wound on a non-magnetic form or bobbin which includes a central (axial) opening in which a magnetic plunger may move. Application of an energizing signal to the coil pulls the plunger up into the coil and, thus, operates the associated mechanism. An iron-clad solenoid is similar except for an iron case which surrounds the coil. This iron case operates on the flux and increases the magnetic pull of the plunger. Other types of solenoids use a fixed core and various types of armatures. Solenoids are widely used for operating circuit breakers, track switches, valves and many other mechanical devices.

Consequently, it is highly desirable to have a relatively simple yet highly reliable solenoid device wherein a simple latching condition can be provided.

PRIOR ART STATEMENT

A preliminary search was conducted by applicant. The results of the search are presented herewith. The patents are listed in numerical order and no special significance is attached thereto.

U.S. Pat. Re. No. 24,209; NEUTRAL RELAY; A. C. Bernstein. This patent is directed to an electromagnetic relay which is magnetically biased to a neutral position.

U.S. Pat. No. 698,027; POLARIZED MAGNET; E. C. Knapp. This patent is directed to a polarized magnetic device having the two ends thereof branched or forked into a pair of magnetic poles of the same polarity.

U.S. Pat. No. 1,552,676; ELECTROMAGNETIC APPARATUS; R. E. H. Carpenter, et al. This invention is directed to an electromagnetic motor apparatus for use as a relay in which a pivotally supported armature is arranged in a space between the poles of an otherwise complete signal magnetic circuit system.

U.S. Pat. No. 2,483,658; POLARIZED ELECTROMAGNETIC RELAY; C. F. Miller. This patent is directed to a polarized relay which includes a permanent magnet and an electromagnet with a moveable armature which is positioned as a result of an electromagnetic current direction.

U.S. Pat. No. 3,968,470; MAGNETIC MOTOR; J. M. Brown. This invention is directed to a magnetic motor for use as an actuator in a relay and includes an electromagnetic winding which has a core member on the opposite ends of which are fastened pole pieces which cooperate with a magnetically moveable armature.

U.S. Pat. No. 4,020,433; RELEASE TYPE ELECTROMAGNETIC DEVICE; M. Uchidoi, et al. This patent is directed to a device which includes a permanent magnet for attracting a moveable iron armature with a permanent magnet sandwiched between two magnetic members and magnetizing windings which embrace each magnetic member between the permanent magnet and the pole faces thereof.

U.S. Pat. No. 4,236,132; ELECTROMAGNETIC SWITCH MEANS FOR A FLOW CONTROL DEVICE AND THE LIKE HAVING REDUCED SHOCK LEVELS; N. Zissimopoulos. This patent is directed to an electro magnetic switch which includes an armature which is pivotally moveable between first, second positions about a fulcrum. Magnets are positioned adjacent each of the armature ends so that the armature can be moved by changing polarity of an electromagnetic core means.

U.S. Pat. No. 4,286,244; ELECTROMAGNETIC ACTUATOR FOR A LATCH RELAY; J. P. Schuessler. This patent is directed to a polarized relay in which the poles of an electromagnet are project toward an armature on either side of a pivot support which allows the armture to pivot toward one pole or the other. A pair of permanent magnets share one pole respectively with the poles of the electromagnet.

U.S. Pat. No. 4,316,167; ELECTROMAGNET WITH A MOVING SYSTEM AND PERMANENT MAGNET, ESPECIALLY FOR CONTACTORS; G. N. Koehler. This patent is directed to a device including a permanent magnet and pole pieces which are accurately guided in axial translational motion within a coil unit. Air-gap zones are located at both ends of the coil unit and a stationa yoke surrounds the two ends of the coil.

U.S. Pat. No. 4,604,599; ELECTROMAGNET COMPRISED OF YOKES AND AN ARMATURE SUPPORTING A PERMANENT MAGNET FITTED ON ITS POLE FACES WITH POLE PIECES THAT PROJECT FROM THE AXIS OF THE MAGNET, THE AXIS BEING PERPENDICULAR TO THE DIRECTION OF MOVEMENT; G. N. Koehler. This patent is directed to an electromagnet which includes yokes which are moveable in relation to an armature and winding surrounding a part of the magnetic circuit. The armatures comprise a magnet fitted with two pole pieces which project past both extremities of the magnet in order to define the air-gap forces. A second armature is also used and is located parallel to the first armature.

U.S. Pat. No. 4,609,899; POLARZIED ELECTROMAGNET HAVING THREE STATES AND A CONTROL CIRCUIT FOR SAID ELECTROMAGNET; G. N. Koehler. This patent is directed to a three-state polarized electromagnet comprising a stationary system surrounded by a coil and a moving system which incorporates a permanent magnet fitted with pole pieces which are bent backwards towards each other to define four air-gaps.

U.S. Pat. No. 4,730,175; POLARIZED ELECTROMAGNET DEVICE; P. Ichikawa et al. This patent is directed to a polarized electromagnet device with a magnetic block moveable within a specially designed yoke in response to the attraction forces of permanent magnets and an electromagnetic coil.

U.S. Pat. No. 4,814,732; MAGNETIC LATCHING ACTUATOR: G. B. Pratt. This patent is directed to a magnetic latching actuator which has a core having at least one electrical coil thereon. The magnet is positioned against a U-shaped magnetic flux connector having two parallel plates. The plates are sufficiently spaced from each other to permit passage of the U-shaped armature therebetween. The armature includes two ends which are designed to alternately engage the core at opposite ends.

SUMMARY OF THE INSTANT INVENTION

This invention is directed to a latching solenoid which includes a plurality of magnetic paths. The magnetic paths interact to provide a solenoid apparatus wherein a plunger can be moved relative to a coil. More importantly, the plunger is caused to latch in a particular position. That is, the plunger can be moved, axially, in either direction relative to a coil. It can be latched in specified positions as a result of magnetic operation even though the energizing signal is removed from the coil. The solenoid includes a pair of magnetic circuit paths in which magnetic flux fields are created by permanent magnets. In addition, supplemental magnetic flux fields are created in the magnetic circuit paths as a result of the application of the energizing signal to the coil. The supplemental magnetic flux field created by the signal is used to move the plunger from one latched position to the other. Permanent magnetic flux fields are used to retain the plunger latched in the particular position which was dictated by the application of the electrical signal.

A subsequent electrical signal, of opposite plurality, is required to move the plunger to a different rest position at which time the plunger is magnetically latched again. The operation is then sequential and controlled by the application of electrical signals to the coil.

DESCRIPTION OF THE PREFERRED EMBODIMENT

Figure 1:
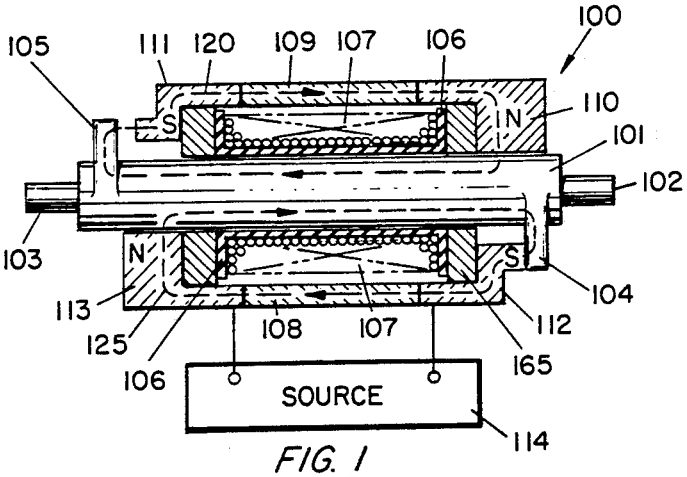
FIG. 1 is a schematic representation of one embodiment of the instant invention in a first rest position.

Referring now to FIG. 1, there is shown a schematic representation of one embodiment of the instant invention. In FIG. 1, the representation is a partially sectional, partially broken away view of the solenoid 100. The solenoid includes a plunger which comprises a central shaft 101 which is formed of magnetizable or magnetic material. Typically, the shaft or core 101 is substantially cylindrical in configuration. End pieces 102 and 103 can be formed at the respective ends of core 101 if so desired. As shown, the end pieces 102 and 103 are of smaller diameter than the core piece 101. Typically, the end pieces 102 and 103 are used to abut against and activate a mechnical device such as an electrical contact or the like. The end pieces, per se, form no portion of the invention and can be omitted, if necessary.

In addition, in the embodiment shown in FIG. 1, a pair of tabs 104 and 105 extend radially from the surface of the core 101. The tabs 104 and 105 can be integrally formed with core 101 or can be fabricated of substantially similar material and attached to the core in a suitable fashion such as welding or the like. The tabs 104 and 105, which can be considered as core pole pieces, extend outwardly from opposite sides of the outer surface of core 101.

The coil 107 which comprises of plurality of windings of electrically conductive material such as wire or the like and is wound on a suitable support bobbin 106. The bobbin 106, typically, formed of non-magnetic, non-conductive material and is arranged to have a central axial opening therethrough. The core 101 is arranged to be moveably mounted within the central opening in bobbin 106. Thus, core 101 can move or slide relative to the bobbin 106.

In addition, there are a plurality of magnetic flux paths arranged relative to the core 101. In particular, at least two separate flux paths are arranged on different sides of the core. In the embodiment shown in FIG. 1, these magnetic flux paths 120 and 125 are arranged on opposite sides of the core. Other arrangements can, of course, be provided and such arrangements are contemplated within this invention.

More particularly, each of the flux paths 120 and 125 includes a typical north pole and a south pole. In the embodiment shown, a permanent magnet 109 is provided substantially centrally positioned in the flux path 120. A pair of pole pieces 110 and 111 are affixed to or mounted at the ends of the permanent magnet 109. Thus, pole pieces assume the north (in this case pole piece 110) and south (in this case pole piece 111) poles as determined by the magnet 109.

A similar but opposite arrangement is provided on the other side of the apparatus. In this instance, a permanent magnet 108 is mounted together with the pole pieces 112 and 113. The pole piece 113 is determined to be the north pole while the pole piece 112 is determined to be the south pole. The north and south pole arrangements as related to magnets 108 and 109, is opposite. Thus, the north pole piece 113 and south pole piece 111 are arranged adjacent to the end piece 103 of the core 101. Conversely, the north pole piece 110 and south pole piece 112 are associated with the end piece 102 of the core 101.

The coil 107 is connected to any suitable source 114 which will, from time-to-time, provide energizing pulses to the coil 107.

While they are not shown in FIG. 1 appropriate support means and the like are provided in any suitable fashion.

Figure 3:
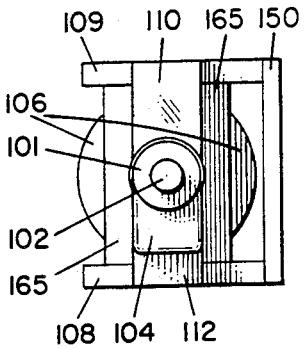
FIG. 3 is a schematic representation of one end view of the embodiment of the invention shown in FIGS. 1 and 2.

To better understand the mechanical arrangement of the apparatus, concurrent reference is made to FIG. 3. In this case, the solenoid 10 includes the bobbin 106, the coil 107 mounted on bobbin 106. The end piece 102 is shown relative to the core 101. The core pole piece 104 extends outwardly, to the right in the illustration, from the core 101. The pole pieces 110 and 112 extend from the respective magnets 109 and 108 inwardly toward the core 101. A suitable base 150 is shown schematically and operates to support the components of the apparatus. Of course, any other suitable mounting arrangement can be made. Moreover, as shown in FIG. 3, the magnets 108 and 109 are relatively large. The pole pieces 110 and 112 could, alternatively, be enlarged and the permanent magnets 108 and 109 can be reduced in size.

Conversely, it is conceivable that the pole pieces 110, 111, 112 and 113 could, in fact, be fabricated of and formed integrally with the permanent magnets 108 and 109. It is not essential that separate pole pieces be utilized. However, the configuration of the magnets and the related pole pieces is a function of economics and/or design.

Referring again to FIG. 1, the magnetic flux paths are depicted in the apparatus and represented by the arrows and the lines 120 and 125. Because of the relationship of the permanent magnets 108 and 109 and the respective pole pieces, the magnetic flux paths are provided in opposite directions in the apparatus. In particular, the magnetic flux produced in core 101 by the respective permanent magnets 108 and 109 is clearly in the opposite direction.

In the embodiment shown in FIG. 1, the magnetic flux path 125 is, of course, inherently stronger than the flux 120. That is, in the rest position shown, referred to as gap B i.e. the gap between pole piece 104 and pole piece 112 is a minimal dimension. In point of fact, the pole pieces 104 and 112 may be in contact so as to provide a substantially closed magnetic flux path.

Conversely, gap A between pole pieces 111 and 105 is open and spaced apart thereby developing an air gap therebetween. The air in gap A inherently adds a significant reluctance to the magnetic flux path and, therefore, significantly reduces the strength of the magnetic flux in the flux path.

That is, the permanent magnets 108 and 109 are substantially identical magnets. The remainder of each of the flux paths is substantially identical in length, width, type of material and so forth. The only difference between the two flux paths is the spacing developed at gap A and gap B. Because gap A is a relatively large air gap, the magnetic field through flux path 120 is significantly reduced. Consequently, the flux path assciated with pole piece 112 and so forth is a stronger field and maintains the plunger, i.e. core 101, latched in the configuration shown in FIG. 1.

In the event that an electrical signal is supplied by source 114 across terminals X1 and X2, the coil 107 is energized and produces its own magnetic flux field. Depending upon the polarity of the signal applied to coil 107, the flux field produced by coil 107 is in the same direction as shown for either flux path 120 or 125. This coil induced field enhances the flux which is co-directional. Thus, if the coil 107 produces a flux in the direction of flux 125, core 100 remains in the condition shown.

In the event that the signal supplied by source 114 is of the opposite plurality, i.e. it is of the appropriate polarity to cause coil 107 to produce a field which is superimposed upon and enhances the field produced by permanent magnet 109, the magnetic field through pole piece 110 and so forth, is enhanced. This modification of the magnetic fields is operative to enhance the attraction between pole pieces 105 and 111 and thus to overcome the attraction between pole pieces 104 and 112. (Depending upon the size of the field produced by the coil 107, there may actually be repulsion between pole pieces 104 and 112.)

As a consequence of the enhanced or modified field, the plunger 100 including core 101 is moved so that pole pieces 105 and 111 are attracted to each other. Thus, gap A is closed. Concurrently, pole pieces 104 and 112 move away from each other and gap B becomes an air gap. This latter configuration is shown in FIG. 2.

Figure 2:
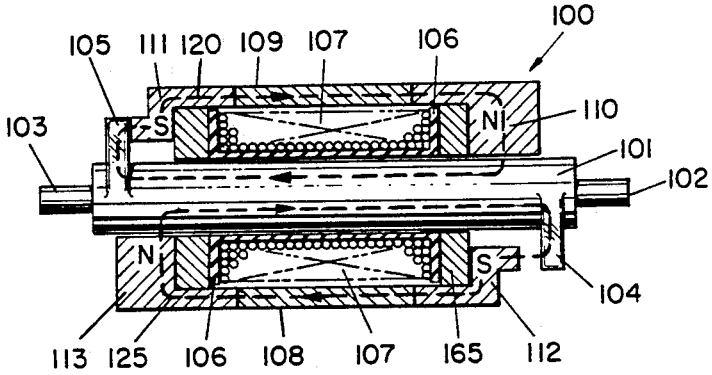
FIG. 2 is a schematic representation of the first embodiment of the instant invention shown in a second rest position.

Referring now to FIG. 2, there is shown a second rest position for this embodiment of the invention. The structure shown in FIG. 2 is identical to the structure shown in FIG. 1. However, this rest position represents the rest position after a signal has been supplied by the source 114 to coil 107 and of such plurality so as to enhance the magnetic flux 120. Thus, the core 101 or plunger of the solenoid has been pulled upwardly or to the right as shown in FIGS. 1 and 2. The gap A between pole pieces 111 and 105 has been reduced to, effectively, zero while gap B has been increased. In essence, gap B, (as shown in FIG. 2) is substantially identical to gap A as shown in FIG. 1. In this instance, the magnetic flux paths remain substantially the same. However, the reluctance in the flux path 125 is now larger than the reluctance in the flux path 120. This is the reverse of the situation shown and described relative to FIG. 1. However, because of the flux produced in the respectiv epaths by the permanent magnets, the solenoid will now remain at rest in the position shown in FIG. 2 until caused to reset by the application of a signal by source 114. This signal will be, of course, of opposite polarity to the signal which was supplied by source 114 to cause the plunger to move from the position shown in FIG. 1.

Figure 4:
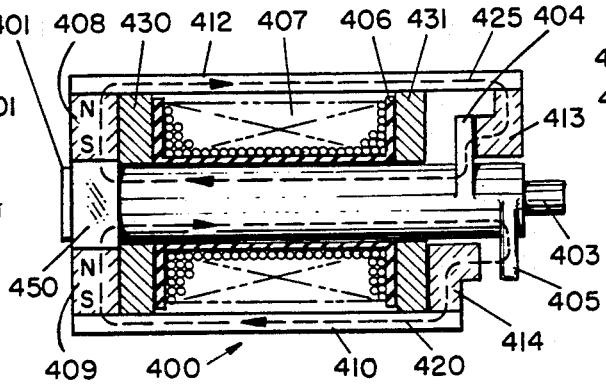
FIG. 4 is a schematic representation of another embodiment of the instant invention shown in a first rest position.

Referring now to FIG. 4, there is shown another embodiment of the instant invention. Again, the configuration is quite similar to configuration shown in FIG. 1. For example, a core 401 is mounted in the central opening of a coil 407 which is wound on a suitable bobbin 406. In this embodiment, the permanent magnets 408 and 409 are provided at one end of the solenoid. This is not an absolute requirement but is used to show an alternative arrangement relative to the arrangement shown in FIG. 1. In this embodiment, the side walls 410 and 412 are formed of magnetizable material which provide portions of the flux paths. They also operate as pole pieces. The pole pieces 414 and 413 are provided at the end of the side pole pieces 410 and 412, respectively.

The core 410 includes the armature tabs 405 and 404, respectively. However, it is noted that the armature tabs 404 and 405 are mounted at the same end but on opposite sides of the core 401. This arrangement permits easier construction of the solenoid and repair, if necessary, of the core apparatus.

It is noted that the armature apparatus is arranged so that the armature tabs will be equally distant from the pole pieces 411 and 413 when the armature is moved from one rest position to the other.

The flux paths 420 and 425 are shown. These flux paths have substantially the same function and operation as the flux paths 120 and 125 as shown in FIGS. 1 and 2. The flux paths are, in essence, developed by the permanent magnets 408 and 409 in conjunction with the remainder of the magnetic flux path components. The magnetic flux is selectively altered by the application of a signal to the coil 407 in the same fashion as shown in FIG. 1. Thus, the respective flux patterns are altered so that the core 401, together with the armature tabs, moves with respect to the coil 407 to selectively achieve and maintain a rest position.

As is the case in the embodiment shown in FIG. 1, the rest position controls the position and location of the end piece 403 (or a counterpart end piece 402, if so desired) thereby to move, position, locate or the like a set of contacts, a relay armature, or similar utilization device.

As shown in FIG. 4, supports 430 and 431 are shown. Typically, the supports 430 and 431 are fabricated of a non-magnetic materials such as brass, teflon, delrin or the like and may include suitable bearings or bearing surfaces fabricated of nylon, delrin or similar material.

Figure 5:
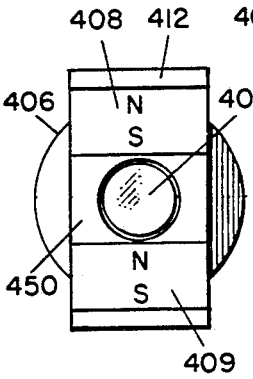
FIGS. 5 and 6 are opposite end views of the embodiment shown in FIG. 4.

Referring to FIG. 5, there is shown one end of the embodiment shown in FIG. 4. In this instance, the core 401 is mounted to pass through an aperture in an end pole piece 450 which is mounted between the permanent magnets 48 and 409. The magnets 408 and 409 are mounted to pole pieces 412 and 410, respectively. The components shown in FIGS. 4 and 5 may be held together by appropriate screws, welds or any other suitable arrangement.

Figure 6:
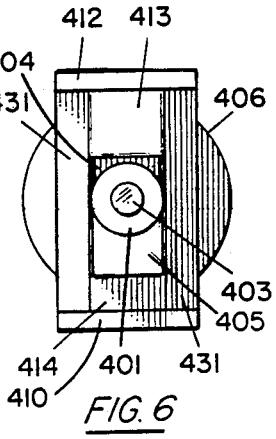

Referring now to FIG. 6, there is shown the other end of the solenoid 400 as shown in FIGS. 4 and 5. Again, the side pieces 412 and 410 are mounted at the outer edges of the unit. The pole pieces 411 and 413 are mounted to the side pieces 410 and 412, respectively. The pole pieces can be mounted in any suitable fashion and, in some cases, may be integrally formed with the respective side pieces.

The end piece 403 of the core 401 extends outwardly from the plane of the illustration. The armature tabs 404 and 405 extend radially outwardly from the surface of core 401. The core is arranged to move axially through the opening in coil 407 which is mounted on bobbin 406. In the embodiment shown in FIG. 6, a suitable support which is fabricated of a low friction, non-magnetic material such as brass, teflon, delrin or the like may be provided.

Again, the operation of the plunger of the two embodiments is controlled by the application of an electrical signal to the coil which produces a magnetic flux which enhances one of the flux paths produced by the permanent magnets in the magnetic structure. Thus, the plunger of the solenoid is selectively caused to move. Moreover, after the plunger has moved, it is maintained or latched in a "rest" position solely due to the flux produced by the permanent magnet pending the application of another control signal to the electromagnetic coil.

Thus, there is shown and described an improved solenoid construction. This construction permits selective movement of a solenoid plunger and also permits the plunger to be retained in a latched position in the absence of an electrical control signal. Thus, a one shot operation or a semi-permanent control position is achieved. The construction shown and described above is intended to be illustrative only. It is not intended to be limitative. Those skilled in the art may conceive modifications or variations to the concept as shown and described. However, any such modifications or variations which fall within the description of this invention are intended to be included therein as well. Thus, the scope of the invention is limited only by the claims appended hereto.

I claim:

1. A solenoid comprising,
a coil means including an electrical conductor,
a moveable member within said coil means,
a magnetic flux path means disposed adjacent to said moveable member and adapted to retain said moveable member in a specified position,
said magnetic flux path means operative to continuously produce opposite sense magnetic flux fields of substantially constant strength within said moveable, and permanent magnet means associated with said magnetic flux path means in order to provide and maintain said substantially constant magnetic flux fields in said moveable member member.

2. The solenoid recited in claim 1 wherein,
said moveable member includes at least one tab means which extends from the surface thereof and selectively engages said magnetic flux path means.

3. The solenoid recited in claim 1 wherein,
said moveable member includes a second tab means which extends from the surface thereof and selectively engages said magnetic flux path means.

4. The solenoid recited in claim 3, wherein,
said one tab means and said second tab means are located at opposite ends of said moveable means.

5. The solenoid recited in claim 3 wherein,
said moveable member comprises a cylindrical member of magnetizable material.

6. The solenoid recited in claim 5 wherein,
said one tab means and said second tab means extend radially from said moveable member.

7. The solenoid recited in claim 1 including,
bobbin support means for supporting said coil means.

8. A latching solenoid comprising,
a cylindrical core of magnetizable material,
first and second tab members which extend in opposite radial directions from said core,
a conductive coil,
a non-magnetic support means for carrying said conductive soil,
said support means including an axial aperture therethrough for moveably receiving said core,
first and second separate flux path means arrayed on different sides of said core, and
first and second permanent magnets respectively included in said first and second flux path means,
said first and second permanent magnets arranged in the opposite polarity sense within said first and second separate flux path means respectively whereby said first and second flux path means provide opposite magnetic polarity to said core and produce magnetic flux fields of opposite and constant sense relative to each other within said core.

9. The solenoid recited in claim 8 wherein, said first and second tab members are disposed at opposite ends of said core.

10. The solenoid recited in claim 8 wherein, said first and second separate flux path means are disposed on opposite sides of said core.

11. The solenoid recited in claim 8 wherein, said first and second permanent magnets are substantially identical.

12. The solenoid recited in claim 8 including, pole pieces mounmted at at least one end of said permanent magnets.

13. The solenoid recited in claim 8 wherein, said first and second tab means alternately engage said first and second flux path means to affect the reluctance of the respective flux path means.

14. A solenoid comprising, plunger means;

first and second permanent magnet means disposed adjacent to said plunger means so as to produce first and second substantially constant magnetic flux fields through said plunger means;

said first and second magnetic flux fields having opposite and constant polarity sense relative to each other in said plunger means; and electromagnetic coil means disposed adjacent to said plunger means and adapted to selectively produce a further magnetic flux field through said plunger means which further magnetic flux field is combined with said first and second magnetic flux fields to selectively cause said plunger means to move.

15. The solenoid recited in claim 14 including, support means for supporting said permanent magnet means and said coil means relative to said plunger means.

16. The solenoid recited in claim 14 wherein, said electromagnetic coil means comprises a single coil structure which substantially surrounds said plunger means.

17. The solenoid recited in claim 14 wherein, said first and second permanent magnet means are disposed external to said coil means.

18. The solenoid recited in claim 14 wherein, said first and second permanent magnet means are disposed substantially parallel to said plunger means.

* * * * *